US007625323B1

(12) United States Patent
Lin

(10) Patent No.: US 7,625,323 B1
(45) Date of Patent: Dec. 1, 2009

(54) SWING ROTARY FITNESS APPARATUS

(75) Inventor: Shih-Yuan Lin, Xiamen (CN)

(73) Assignee: Xiamen Kang Sou Fitness Co., Xiamen (CN)

( * ) Notice: Subject to any disclaimer, the term of this patent is extended or adjusted under 35 U.S.C. 154(b) by 0 days.

(21) Appl. No.: 12/358,525

(22) Filed: Jan. 23, 2009

(51) Int. Cl.
*A63B 21/008* (2006.01)
*A63B 22/14* (2006.01)
*A63B 21/02* (2006.01)
*A63B 26/00* (2006.01)

(52) U.S. Cl. ..... 482/112; 482/146; 482/123; 482/140

(58) Field of Classification Search ..... 482/111–113, 482/146, 140, 121–123
See application file for complete search history.

(56) References Cited

U.S. PATENT DOCUMENTS 5,529,557 A * 6/1996 Barton ..... 482/95
5,582,567 A * 12/1996 Chang ..... 482/146
5,941,807 A * 8/1999 Cassidy et al. ..... 482/146
6,758,792 B1 * 7/2004 Chang ..... 482/54
7,004,895 B2 * 2/2006 Perry et al. ..... 482/146
7,322,914 B1 * 1/2008 Vittone et al. ..... 482/146
7,374,522 B2 * 5/2008 Arnold ..... 482/146
7,413,534 B2 * 8/2008 Bucay-Bissu et al. ..... 482/112
7,438,675 B2 * 10/2008 Lin ..... 482/140
2007/0027009 A1 * 2/2007 Arnold ..... 482/146
2007/0255191 A1 * 11/2007 Cozzo et al. ..... 602/23
2007/0298945 A1 * 12/2007 Mehta ..... 482/130
2008/0280741 A1 * 11/2008 Baek ..... 482/146

FOREIGN PATENT DOCUMENTS

CN 2897325 Y 5/2007

* cited by examiner

*Primary Examiner*—Fenn C Mathew
(74) *Attorney, Agent, or Firm*—Rabin & Berdo, P.C.

(57) ABSTRACT

A swing rotary fitness apparatus is described. A swing base is axially disposed at a center of a bracket having a pair of handles. A pound-force adjuster is disposed between the swing base and the bracket, and elastic elements for restoration are disposed between the swing base and the bracket. In addition, a rotatable seat is disposed on the swing base. When a user rides on the seat, the user exerts a force by lumbar muscles, so as to generate a circumferential motion of synchronous swing and rotation, which increases amplitude of twisting lumbar muscles greatly and thus improves an effect of exercising the waist.

9 Claims, 6 Drawing Sheets

SWING ROTARY FITNESS APPARATUS

BACKGROUND OF THE INVENTION

1. Field of Invention

The present invention relates to a fitness equipment for exercise of a user, and more particularly to a fitness apparatus structure for synchronous swinging and rotating motions.

2. Related Art

Generally, fitness equipment is designed to have different exercise motions, and thus parts of muscles of the human body that can be exercised are different. Currently, common fitness equipment includes running machines, fitness bicycles, weight training machines, and the like. All the fitness equipment is inconvenient to store because the volume is too large, and is inconvenient for use in a small room. Moreover, each kind of the fitness equipment is designed for a certain part of muscles of the human body, and is difficult to achieve the purpose of shaping a large range of muscles of the human body.

Therefore, the inventor of the present invention has designed a fitness equipment that uses a torque to swing the human body so as to achieve the exercise effect. Referring to FIG. 1, a "swing torsional fitness apparatus" disclosed in China Utility Model Patent No. CN2897325 is shown. A body 1 includes a lower bracket 11, a rotary disc 12, and a pound-force adjuster 13. The rotary disc 12 is disposed on a central bracket 111 of the lower bracket 11, and has rolling elements 121 disposed therein, such that an upper disc 122 of the rotary disc 12 may rotate by 360 degrees in plane relative to a bottom disc 123. A non-slip belt 131 of the pound-force adjuster 13 is fitted on the upper disc 122, so as to control a pound force of the upper disc 122 in rotation by controlling tightness of the non-slip belt 131. The body 1 and a foot stand 14 are combined to form a chair shape, such that a user can perform a rotational motion of the waist in a sitting posture, so as to exercise the lumbar muscles and shape the waist line.

However, the swing torsional fitness apparatus can only perform a rotational motion, so the lumbar muscles can be exercised in a quite limited range. Thus, the ideal effect can be achieved only after long-time and continual exercise. In view of this, the inventor of the present invention adds a swing structure on the basis of the original rotary disc structure, which increases the motion amplitude of the rotary disc and thus enhances the exercise of lumbar muscles, so as to improve the exercise effect greatly.

SUMMARY OF THE INVENTION

Accordingly, the present invention is directed to a swing rotary fitness apparatus, which enhances exercise of abdominal muscles significantly, and improves an effect of shaping a waist line.

In order to achieve the above objective, a swing rotary fitness apparatus provided in the present invention at least includes a bracket, a swing base, a pound-force adjuster, and a seat. A handle is disposed at each of two sides of the bracket, and shaft holes are arranged at a center of the bracket. A shaft coupling portion is disposed on a bottom of the swing base, such that the swing base is moveably and axially disposed at the center of the bracket, and may swing reciprocally relative to the bracket. An end of the pound-force adjuster is axially disposed at the bottom of the swing base, and the other end is axially disposed at one side of the bracket. Moreover, elastic elements for restoration are disposed between each of two sides of the swing base and the bracket, and can generate a force for the swing base to restore an original position after swinging so as to maintain the swing base at the center of the bracket. The seat is moveably and axially disposed at a center of the swing base, such that the seat is reciprocally rotatable relative to the swing base.

In use, a user rides on the seat in a sitting posture and exerts a force by lumbar muscles to drive the swing base to swing, and the seat may rotate synchronously, such that the user does exercises such as twisting and stretching lumbar muscles at the same time, so as to enhance exercise of lumbar muscles greatly and achieve the purpose of shaping a waist line effectively.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In order to make the contents of the present invention comprehensible, the present invention is illustrated below with reference to the accompanying drawings.

Figure 1:
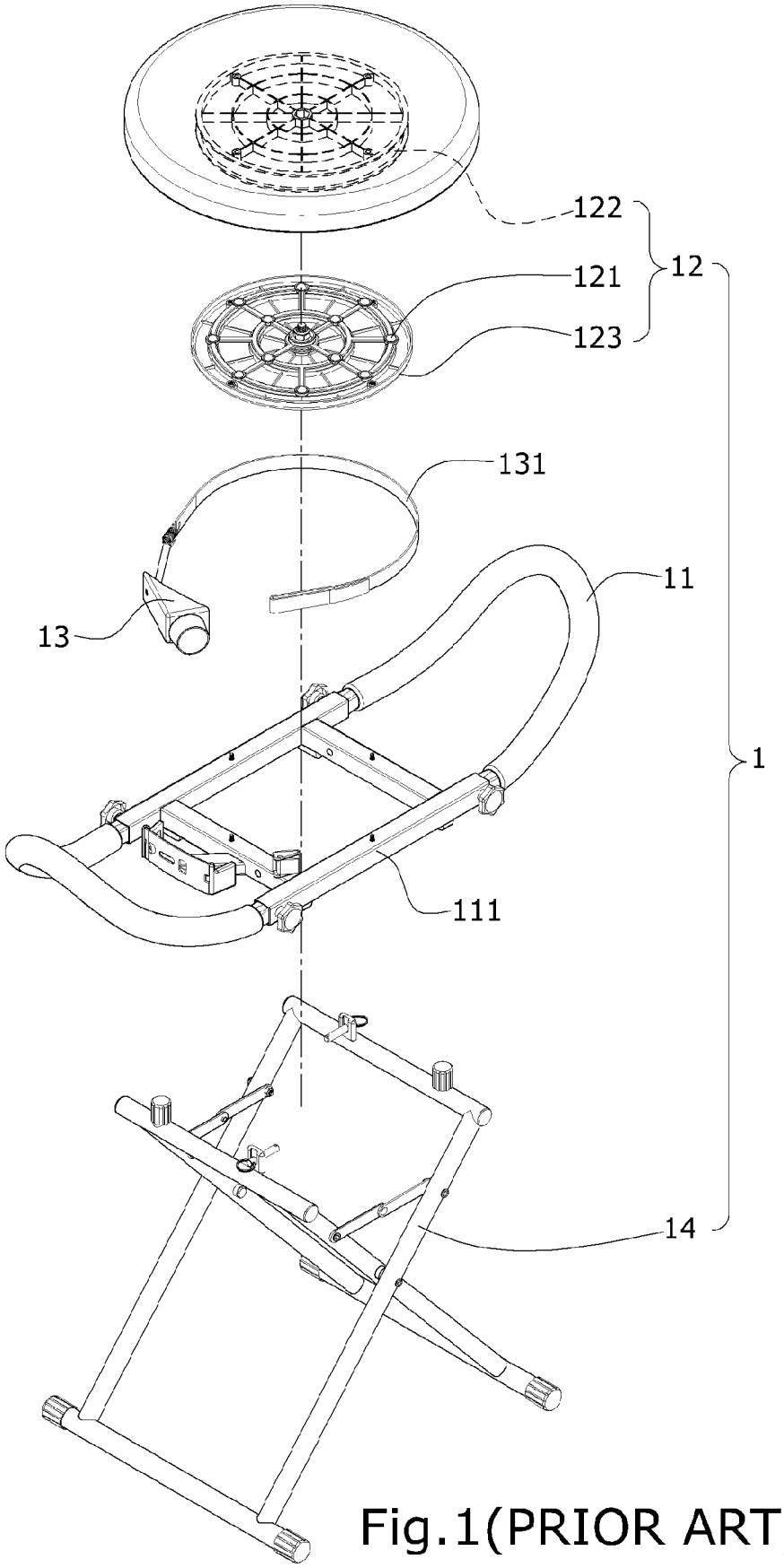
Fig.1(PRIOR ART)
FIG. 1 is a schematic structural view of a conventional swing torsional fitness apparatus.
Figure 2:
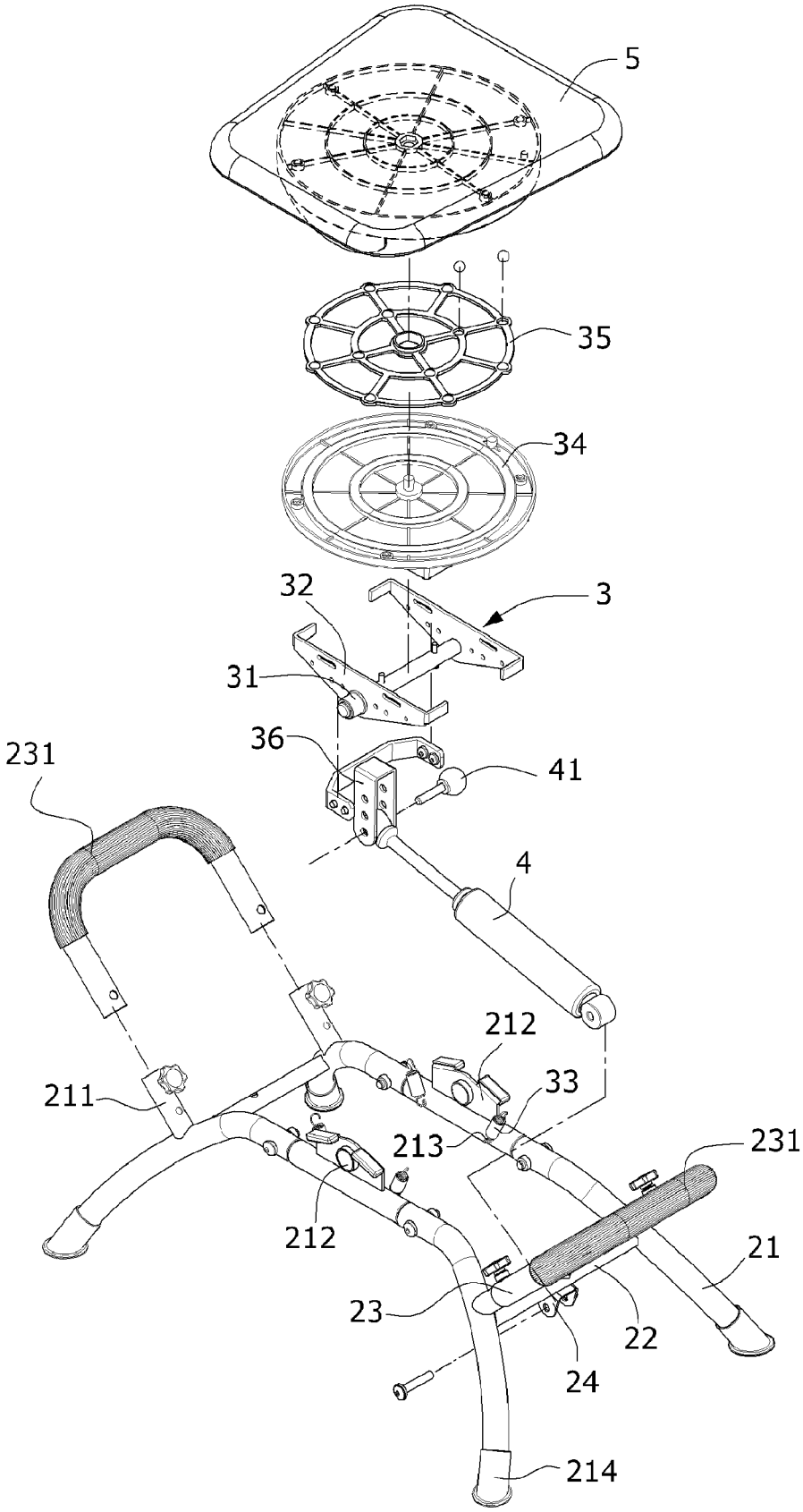
FIG. 2 is a three-dimensional exploded view of a preferred embodiment of the present invention.
Figure 3:
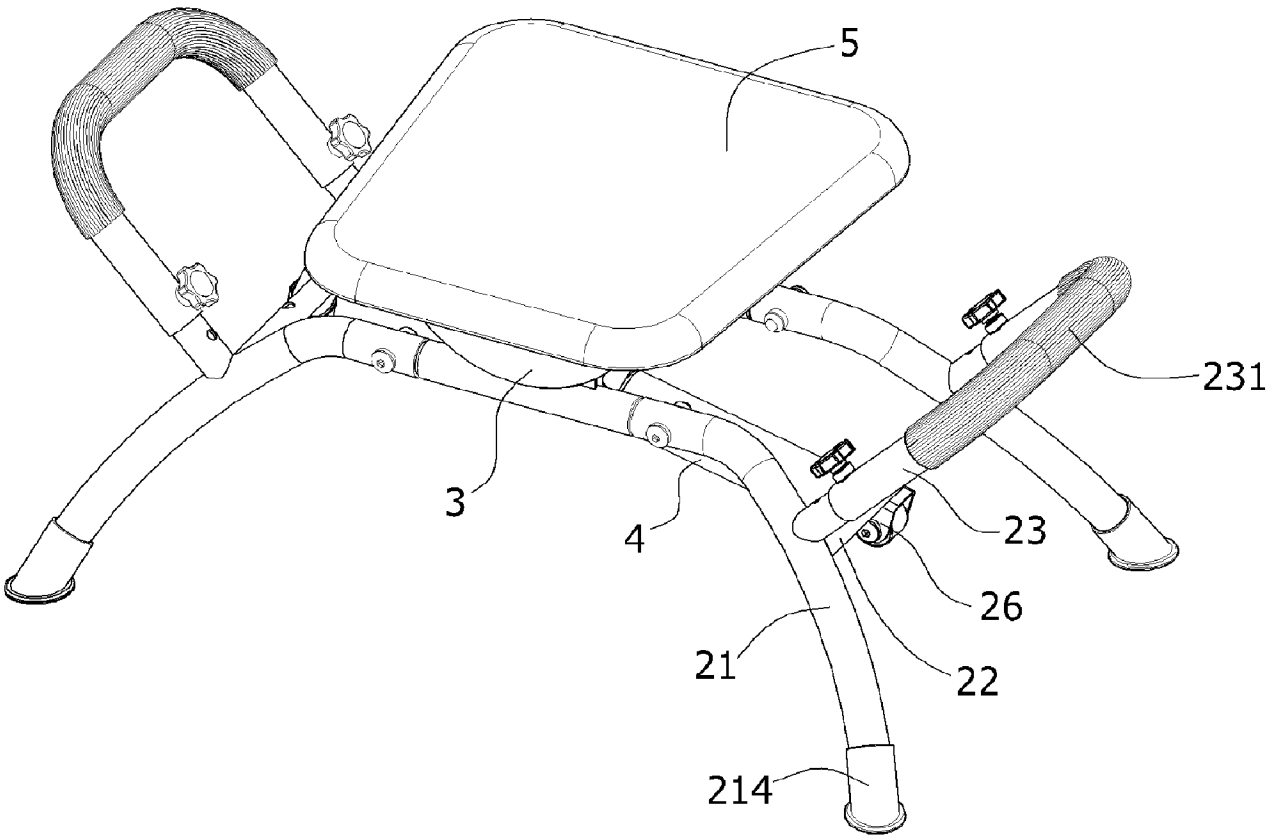
FIG. 3 is a three-dimensional outside view of the preferred embodiment of the present invention.

Referring to FIGS. 2 and 3, the swing rotary fitness apparatus according to a preferred embodiment of the present invention includes the following members.

A bracket 2 includes arc foot stands 21 respectively disposed at two sides, and a plurality of cross rods 22 is connected between the two arc foot stands 21, such that an area of the arc foot stands 21 expanding outwards is larger than an area of a seat 5 so as to maintain a center of gravity in use. Moreover, the arc foot stands 21 are respectively provided with fitting pillars 211 for fitting handles 23. The handles 23 are provided with antislip foamed plastic 231 wrapping surfaces thereof. A shaft hole 212 is disposed at a center of each of the two arc foot stands 21, and a plurality of hook portions is respectively arranged at two sides of each shaft hole 212. Besides, bottoms surrounding the arc foot stands 21 are each provided with an antislip foot pad 214.

A shaft coupling portion 31 is disposed on a bottom of a swing base 3, such that the swing base 3 is moveably and axially disposed in the shaft holes 212 at the center of the bracket 2, and swings reciprocally relative to the bracket 2. Moreover, a plurality of hook holes 32 is arranged at the bottom of the swing base 3, such that two ends of elastic elements 33 are respectively hooked to the hook portions 213 of the bracket 2 and the hook holes 32 of the swing base 3. Through the resilience of the elastic elements 33 at two sides, a force for the swing base 3 to restore an original position after swinging may be generated, such that the swing base 3 remains vertically disposed at the center of the bracket 2 and is convenient for the user to ride. In addition, an annular slot 34 is arranged on a top of the swing base 3, and a plurality of rolling elements 35 is disposed in the annular slot 34.

One end of a pound-force adjuster 4 is axially disposed on a joint seat 36 at the bottom of the swing base 3, and the other end is axially disposed on a joint seat 24 at one side of the bracket 2, such that the pound-force adjuster 4 remains connected between the swing base 3 and the bracket 2, as shown in FIG. 2. In the present invention, a pneumatic rod is used as the pound-force adjuster 4, which generates a proper resistance when stretched outwards or pressed inwards, so as to increase or decrease a pound force pushing the swing base 3 to swing. Moreover, an adjusting knob 41 is disposed on the pound-force adjuster 4, so as to rapidly adjust a pound force when the swing base 3 swings reciprocally.

The seat 5 is moveably and axially disposed in the annular slot 34 at the center of the top of the swing base 3. Driven by the rolling elements 35, the seat 5 may reciprocally rotate in plane relative to the swing base 3.

Figure 4:
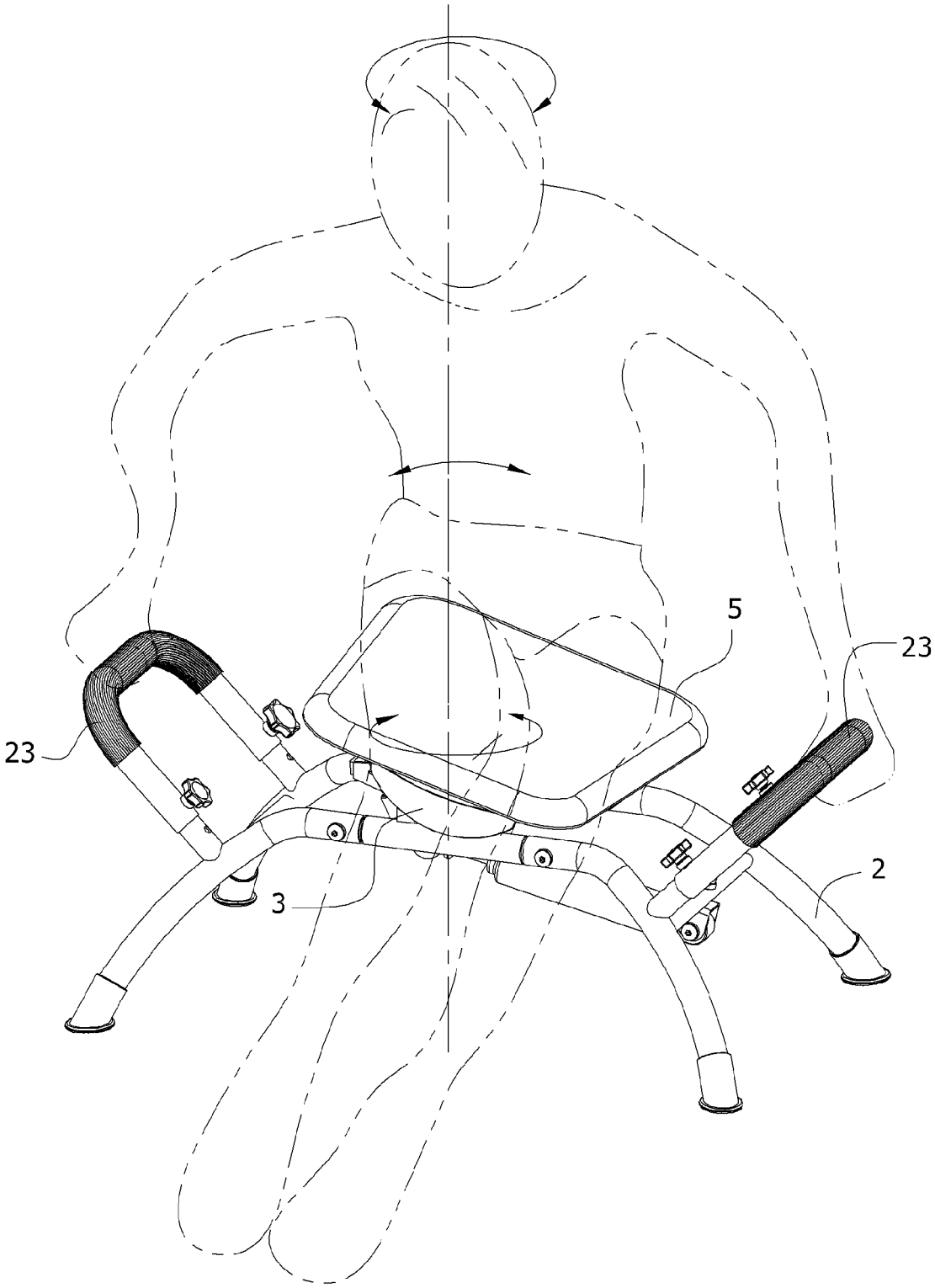
FIG. 4 is a schematic view (I) illustrating an operation of the preferred embodiment of the present invention in use.
Figure 5:
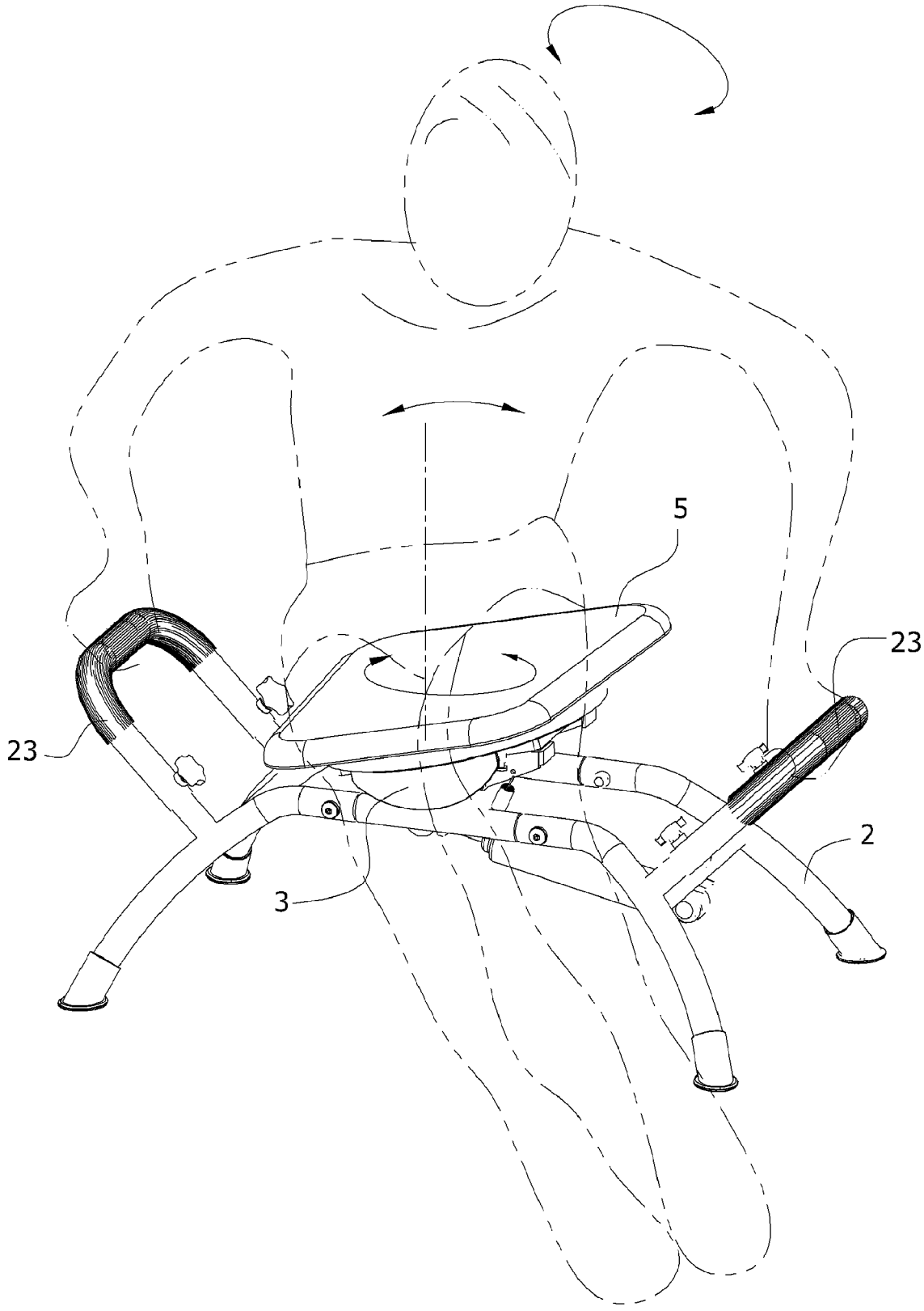
FIG. 5 is a schematic view (II) illustrating an operation of the preferred embodiment of the present invention in use.
Figure 6:
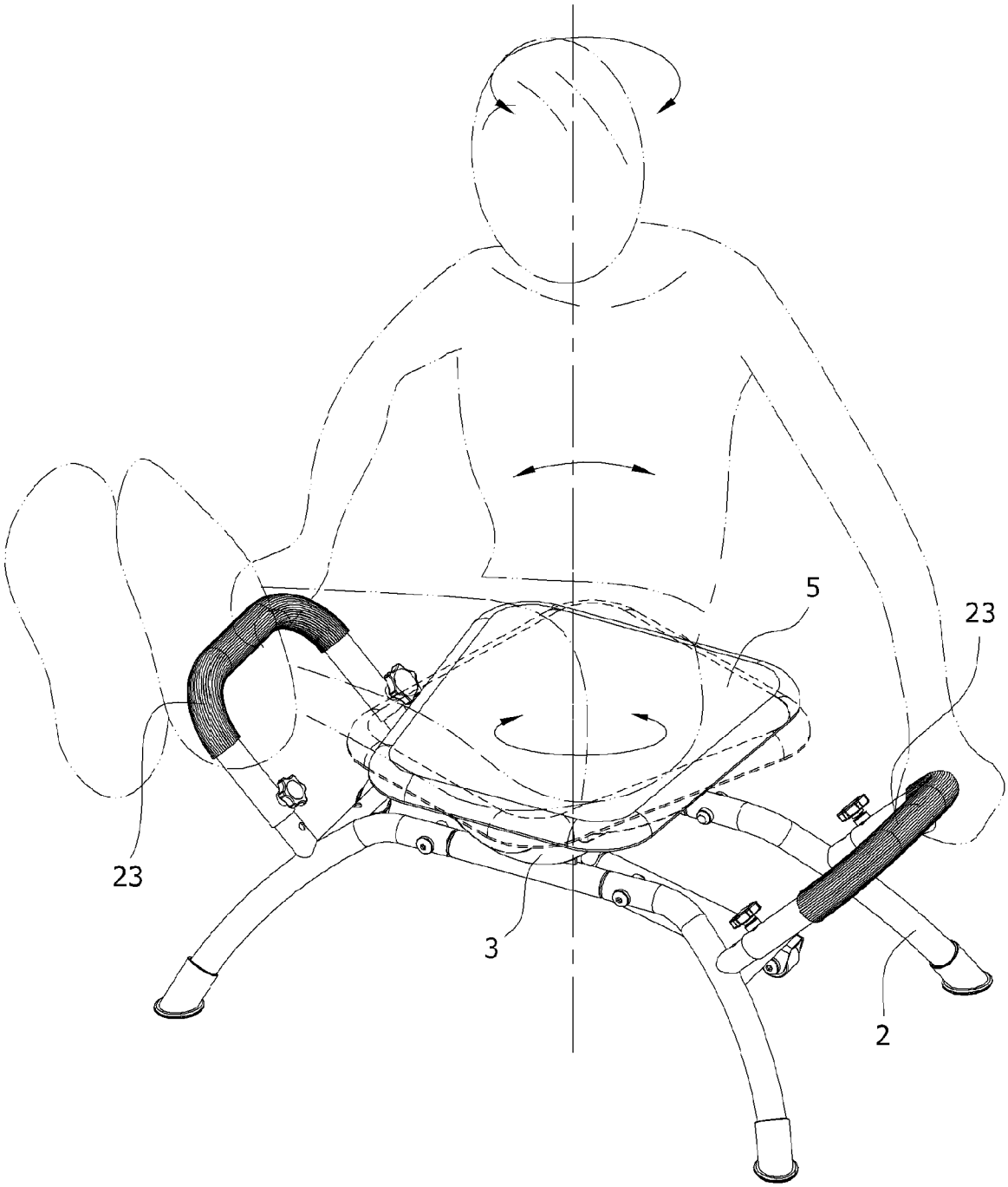
FIG. 6 is a schematic view (III) illustrating an operation of the preferred embodiment of the present invention in use.

In use, referring to FIGS. 4-6, the user rides on the seat 5 in a sitting posture, grips the handles 23 at two sides of the bracket 2 with both hands, lifts both feet from the ground, and exerts a force by lumbar muscles to drive the swing base 3 to swing left and right, and the seat 5 rotates in plane synchronously. As such, the body of the user is twisted to a large extent, and the user does exercises such as twisting and stretching lumbar muscles at the same time, so as to enhance the exercise of lumbar muscles. Thus, muscles extending from the waist to legs and chest may be exercised, thereby achieving the purpose of shaping the waist line and leg line effectively.

As described above, the present invention has the following advantages in implementation, as shown in FIGS. 2-6.

1. In the present invention, the swing base 3 is moveably and axially disposed at the center of the bracket 2, and the rotatable seat 5 is further disposed on the swing base 3, so as to generate synchronous swing and rotation in use to twist and stretch muscles in the abdomen and improve the effect of exercising muscles near the waist greatly, thereby shaping the waist line effectively.

2. Moreover, since the pound-force adjuster 4 is provided in the present invention, the pound force during the exercise is increased, so as to improve the exercise effect.

3. The elastic elements 33 in the present invention may keep the swing base 3 in a vertical direction at the center of the bracket 2, which increases convenience in use.

A preferred embodiment of the present invention is described above, which does not limit the implementing scope of the present invention. Other variations such as selection of the pound-force adjuster, selection of the elastic elements, the shape of the seat, or the like all fall within the scope of the present invention. It will be apparent to those skilled in the art that various modifications and variations can be made to the structure of the present invention without departing from the scope or spirit of the present invention. In view of the foregoing, it is intended that the present invention cover modifications and variations of this invention provided they fall within the scope of the following claims and their equivalents.

In view of the above, the swing rotary fitness apparatus of the present invention has a creative step of a patent and also has industrial applicability. Therefore, the applicant files the application for a utility model patent to the Intellectural Property Office according to the provisions of the Patent Act.

What is claimed is:

1. A swing rotary fitness apparatus, at least comprising:

a bracket, wherein a handle is disposed at each of two sides of the bracket, and shaft holes are arranged at a center of the bracket;

a swing base, moveably and axially disposed at the center of the bracket, wherein a shaft coupling portion is disposed on a bottom of the swing base, such that the swing base such that the swing base is moveably and axially disposed at the center of the bracket, and swings reciprocally relative to the bracket;

a pound-force adjuster, moveably and axially disposed between the swing base and the bracket, which generates a resistance when stretched outwards or dressed inwards, so as to increase or decrease a pound force pushing the swing base to swing;

elastic elements for restoration that are disposed between each of two sides of the swing base and the bracket, and are capable of generating a force for the swing base to restore an original positioning after swinging so as to maintain the swing base at the center of the bracket; and a seat, moveably and axially disposed at a center of the swing base, such that the seat is reciprocally rotatable relative to the swing base.

2. The swing rotary fitness apparatus according to claim 1, wherein the bracket comprises arc foot stands respectively disposed at two sides, and a plurality of cross rods is disposed between the two arc foot stands, such that an area of the arc foot stands expanding outwards is larger than an area of the seat.

3. The swing rotary fitness apparatus according to claim 2, wherein bottoms surrounding the foot stands are each provided with an antislip foot pad.

4. The swing rotary fitness apparatus according to claim 1, wherein fitting pillars for fitting handles on the fitting pillars are respectively disposed on two sides of the bracket.

5. The swing rotary fitness apparatus according to claim 1, wherein a plurality of hook portions is disposed at two sides of the shaft holes at the center of the bracket respectively, and a plurality of hook holes is arranged at the bottom of the swing base, such that two ends of the elastic elements are respectively hooked in the hook portions of the bracket and the hook holes of the swing base.

6. The swing rotary fitness apparatus according to claim 1, wherein the handles are wrapped by antislip foamed plastic.

7. The swing rotary fitness apparatus according to claim 1, wherein an annular slot is disposed on a top of the swing base, and a plurality of rolling elements is disposed in the annular slot, such that the seat is reciprocally rotatable when moveably and axially disposed in the annular slot.

8. The swing rotary fitness apparatus according to claim 1, wherein an adjusting knob for adjusting a pound force when the swing base swings reciprocally is disposed on the pound-force adjuster.

9. The swing rotary fitness apparatus according to claim 1, wherein an end of the pound-force adjuster is axially disposed on a joint seat at the bottom of the swing base, and the other end of the pound-force adjuster is axially disposed on a joint seat at one side of the bracket.

* * * * *